United States Patent [19]

Rademacher

[11] Patent Number: 4,616,369

[45] Date of Patent: Oct. 14, 1986

[54] AQUATIC TURBULENCE SUPPRESSION DEVICE

[75] Inventor: Thomas P. Rademacher, Medina, Ohio

[73] Assignee: McNeil Corporation, Akron, Ohio

[21] Appl. No.: 738,294

[22] Filed: May 28, 1985

[51] Int. Cl.[4] ..... E04H 3/16

[52] U.S. Cl. ..... 4/497; 441/133

[58] Field of Search ..... 4/497, 505; 441/133

[56] References Cited

U.S. PATENT DOCUMENTS

| | | | |
|---|---|---|---|
| 3,011,178 | 12/1961 | Stone . | |
| 3,074,083 | 1/1963 | Schirmer . | |
| 3,116,925 | 1/1964 | Welch . | |
| 3,304,560 | 2/1967 | Kiefer . | |
| 3,498,246 | 3/1970 | Kiefer . | |
| 3,540,063 | 11/1970 | Stanwood | 4/497 |
| 3,755,829 | 9/1973 | Walklet | 4/497 |
| 3,786,521 | 1/1974 | Walklet | 4/497 |
| 3,793,657 | 2/1974 | Kaas | 441/133 |
| 3,886,602 | 6/1975 | Stanwood | 4/497 |
| 3,950,750 | 8/1962 | Harrison . | |
| 4,048,677 | 9/1977 | Kajlich | 4/497 |
| 4,052,755 | 10/1977 | Baker | 4/497 |

FOREIGN PATENT DOCUMENTS

| | | | |
|---|---|---|---|
| 2377503 | 9/1978 | France | 4/505 |
| 1120868 | 7/1968 | United Kingdom . | |

*Primary Examiner*—Stephen Marcus
*Assistant Examiner*—Leo James Peters
*Attorney, Agent, or Firm*—Renner, Kenner, Greive, Bobak & Taylor

[57] ABSTRACT

A device (15, 18) for use in a body of water (10) as one of a plurality of such devices assembled in axial alignment with one another along a restraining element (16) to suppress incident wave turbulence, the devices having a hub (19, 119) adapted to receive the restraining element, a plurality of planar vanes (23, 123) for directing incident water extending generally radially and axially of the hub, an annular baffle (21, 121) disposed proximate the radial extremity of the vanes, a web (20, 120) for suppressing turbulence extending radially of the hub and oriented substantially perpendicular to the vanes, and elements (30, 130) on the hub precluding relative rotation between adjacent of such devices assembled along the restraining element.

18 Claims, 6 Drawing Figures

AQUATIC TURBULENCE SUPPRESSION DEVICE

TECHNICAL FIELD

This invention relates generally to aquatic devices; and, more particularly to an improved device for defining racing lanes and reducing turbulence in swimming pools and other bodies of water.

BACKGROUND ART

A pioneer device of this general type is described and claimed in U.S. Pat. No. 3,304,560, granted to Adolph G. Kiefer on Feb. 21, 1967, assigned to the assignee of the present application and entitled "Turbulence-Reducing Device for Swimming Pools".

The Kiefer patent discloses a series of hollow cylindrical elongated bodies having perforated surfaces defined by a series of integrally molded plastic strips which criss-crossed each other in what may be called a lattice-work fashion. These bodies are confined in axial alignment by means of a line, or cable, attached at opposite ends of a swimming pool and maintained under tension for the purpose of holding the individual bodies substantially one-half submerged. In addition, since the assembly of lattice-like bodies and cable has a slightly negative buoyancy, floats are attached to the cable (or to the bodies) to assist in maintaining the bodies at a desired level in a body of water.

This assembly of bodies can be described as being designed to substantially eliminate the passage of disturbed water, caused by the efforts of a high-speed swimmer proceeding in one racing lane, from being transmitted to the next adjacent lane. This results from the fact that the turbulence of the wake produced by the moving swimmer is absorbed, or dampened, when it reaches the turbulence reducing bodies by the fact that the waves and troughs forming the wake are broken up and water is aerated reducing driving force of waves due to the perforated surfaces and portions of the kinetic energy in the wake is absorbed by efforts expended in rotating the turbulence reducing bodies which are freely rotatable about the restraining cable.

A later form of device of this general type is disclosed and claimed in U.S. Pat. No. 3,755,829 granted to Mercer Donald Walklet on Sept. 4, 1973, assigned to the assignee of the present invention and entitled "Turbulence Suppression Apparatus for a Body of Water". The wave suppression assembly comprises a continuous series of open-faced perforated discs, resembling spoked wheels, strung together in axially aligned relationship on a taut line, or cable, so that each of the elements is independently freely rotatable about its central axis.

One advantage of the assembly disclosed in the Walklet patent is, therefore, that it is more restrictive to irregular wake patterns, or eddy currents, than prior devices of the Kiefer type in which each of the freely rotatable elements comprised an elongated body. Thus, in the prior art, any force acting, for example on one side of an elongated turbulence reducing body and sufficient to effect movement of the body, created a slight counter turbulence back into the area from which the force acting was generated. In addition, the shorter length and larger diameter of the disc-shaped bodies disclosed in the Walklet patent, having greatly reduced mass, effectively reduces the inertia of each body and makes possible a more localized control of small disturbances in the water.

Further, using a large number of turbulence reducing bodies of individually short axial length means that, as a practical matter, there are no limitations on the dimensions of the racing lanes which can be protected, whereas in the earlier Kiefer assembly, in which each element was approximately a foot, or so, in length, a gap in the lane normally existed at every multiple of the element. This was because the length of the pool was rarely an exact multiple of the length of the element thereby creating an unfilled gap in the lane. The Walklet device, in having the axial length of each element preferably no more than an inch or two, allowed elements to be added, or subtracted, at will so that a continuous barrier along the sides of a lane can always be obtained regardless of the length of the lane in use.

However, a common feature of all of the foregoing prior art turbulence reducing systems is the provision of rotary baffle elements, or damping devices that depend, for their effectiveness, upon the generation of resultant opposite forces resisting the rotation of the damping elements for suppression of wave patterns creating turbulence. Since these two primary developments in the field, refinement has been in the nature of more sophisticated control of the rotation of the baffle elements. This has taken the form in some instances of providing limited resistance to rotation after an element has freely rotated through some angle, normally less than 90°. In other instances elements have been created which are unbalanced as to their physical configuration and/or distribution of mass about their centers of rotation. Consequently, these elements tend to adopt a fixed position relative to a mounting cable and offer an extent of resistance to wave forces causing them to rotate.

These variations to the rotating element concept have not demonstrated an operational superiority, and, in some instances have introduced handling, strength, or other disadvantages.

DISCLOSURE OF THE INVENTION

Therefore, an object of the present invention is to provide an aquatic turbulence suppression device which as part of an assembly of devices suspended on a cable constitutes a combined marker for swimming lanes and a turbulence suppression device. Still another object of the present invention is to provide a turbulence suppression device which employs relatively simple but effective water suppression and damping features as compared with prior devices. Another object of the invention is to provide a turbulence suppression device in which a substantial portion of the turbulence suppression and water damping action is effected by passage of water longitudinally of the lane marker. Yet another object of the invention is to provide a plurality of devices which are substantially nonrotatable relative to adjacent devices and which have vanes that are longitudinal and angularly positioned for directing water longitudinally of the lane markers. A further object of the invention is to provide a device which may be provided with interspersed float elements for purposes of maintaining a desired flotation level of the devices without interferring with the basic consistency of the lane marker configuration.

Another object of the present invention is to provide such a turbulence suppression device which although consisting of a plurality of disk-like devices of rather short axial length requires fewer elements per length of cable than similar prior devices due to the operational possibility of a slightly increased axial dimension of the device. A further object of the present invention is to provide such a device which has disk-like members which do not have sufficient axial length but that they may be closely positioned over the entire length of a body of water spanned by cable attached at cable securing points at or proximate the edges of the water. A still further object of the invention is to provide such a turbulence suppression device which when mounted on a cable to form a lane marker permits adequate pivoting between adjacent devices such that a length of lane marker may be readily coiled about a diameter of several feet to facilitate convenient storage.

In general, the present invention contemplates a device for use in a body of water as one of a plurality of such devices assembled in axial alignment with one another along a restraining element to suppress incident wave turbulence, said devices having a hub adapted to receive the restraining element, a plurality of planar vanes for directing incident water extending generally radially and axially of the hub, an annular baffle disposed proximate the radial extremity of the vanes, a web for suppressing turbulence extending radially of the hub and oriented substantially perpendicular to the vanes, and elements on the hub precluding relative rotation between adjacent of such devices assembled along the restraining element.

PREFERRED EMBODIMENT FOR CARRYING OUT THE INVENTION

Figure 1:
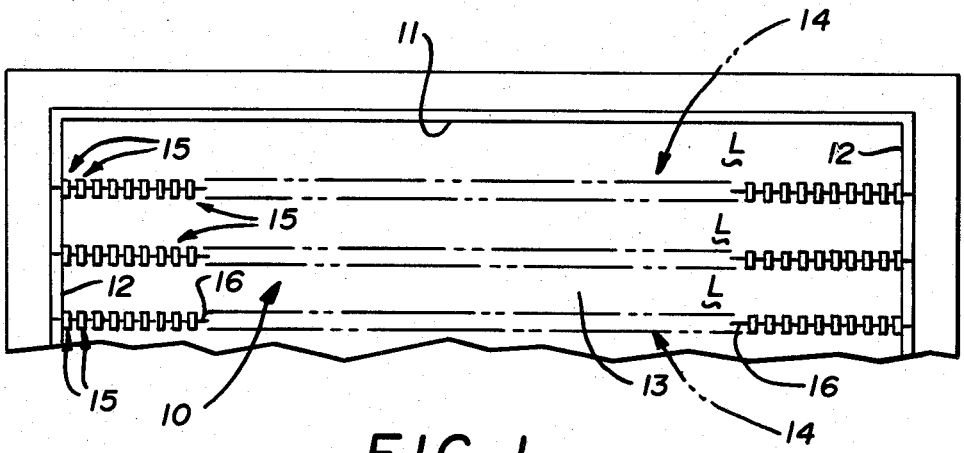
FIG. 1 is a plan view of a portion of a body of water, such as a swimming pool, showing a preferred arrangement of turbulence suppression devices according to the invention axially arranged to form a racing lane marker defining several parallel racing lanes for swimmers.

Referring now to FIG. 1 of the drawings, a fragmentary portion of a typical swimming pool 10, is shown having a side wall 11 and end walls 12 to confine a body of water 13. Extending between the end walls 12 are a series of wave turbulence suppression devices forming a lane marker, indicated generally by the numeral 14, which define a plurality of parallel lanes L in the water each of which is for the use of an individual swimmer taking part in competitive swimming or other aquatic events.

Each of the lane markers 14 is preferably composed of a series of spoked disks, or perforated plate-shaped devices, indicated generally by the numeral 15, which are held in alignment by restraining means, such as a rope, or cable 16 attached to a rigid mounting, such as the opposite end walls 12, of the pool. Preferably, the cable 16 is maintained in a taut condition by a suitable tensioning device, such as a turnbuckle, winding reel, or other conventional means (not shown) well known to persons skilled in the art and is positioned substantially at the water line so that the devices 15 will preferably lie approximately half-submerged, for reasons which will be apparent later.

For practical reasons, the most common form of restraining means is a braided, or twisted, steel wire cable having a plastic coating, such as that sold under the trademark Wirelon, but non-metallic ropes could be employed provided they have sufficient resistance to elongation under tension to keep the devices 15 in substantial alignment and in close axial proximity for reasons which will be detailed hereinafter. However, when wire rope, or other metallic cables are used, which have a specific gravity greater than water, it may be necessary to include additional flotation means to assist in holding the cable substantially at water level along its entire length. While lane marker bodies have been manufactured from lightweight material, such as a cellular synthetic plastic material; it has been found that cellular plastic materials normally are either too fragile for continuous everyday use or, are too expensive to mass produce. Therefore it has been found preferable to mold the devices 15 from unfoamed plastics, such as polyethylene or the like which, when completed, have a specific gravity only slightly less than water and to include means such as the floats, indicated generally by the numeral 17, (FIGS. 2 and 6), deployed at intervals along the length of the lane marker. The result is to provide the marker as a whole with what may be considered a substantially uniformly distributed effective specific gravity changed to sufficiently less than that of water to uniformly elevate the entire length of the lane to approximately half submerged.

Figure 2:
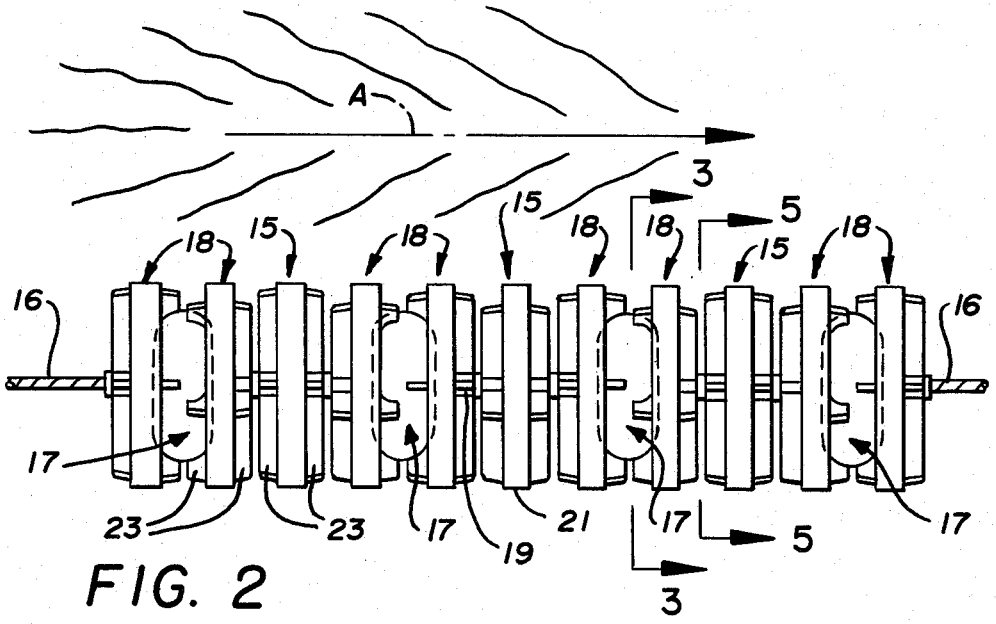
FIG. 2 is an enlarged fragementary top plan view of a portion of one of the racing lane markers of FIG. 1 showing a plurality of turbulence suppression devices and depicting schematically a swimmer and accompanying wake in relation thereto.
Figure 6:
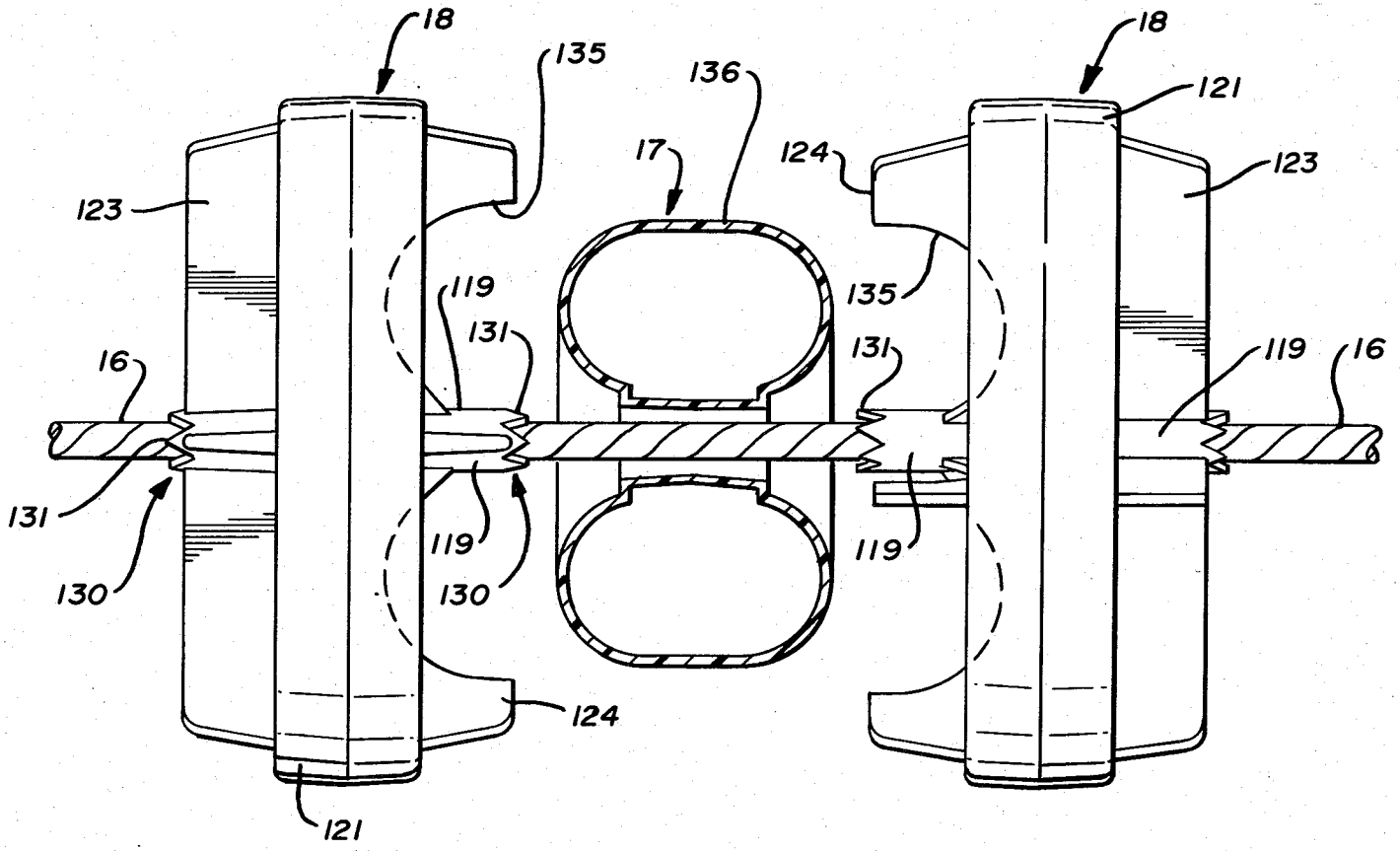
FIG. 6 is an exploded side elevational view of a fragmentary portion of the lane marker of FIG. 2 depicting turbulence suppression devices modified to be positioned to either side of an exemplary float employed to vertically position the lane marker in the body of water.

Furthermore, in order to accommodate the various floats 17 without substantially altering the uniformity of the wave damping pattern presented by the series of devices 15, a pair of modified forms of wave damping devices, indicated generally by the numeral 18 in FIGS. 2 and 6, are preferably positioned on either side of each of the spaced floats 17 in the lane. It is to be appreciated that floats 17 are shown in random spacing in FIGS. 1 and 2. For the type of material and configuration depicted herein, normally one or two devices 15 would be positioned between modified damping devices 18 accompanying floats 17 to accomplish the desired flotation level for optimum performance.

Figure 4:
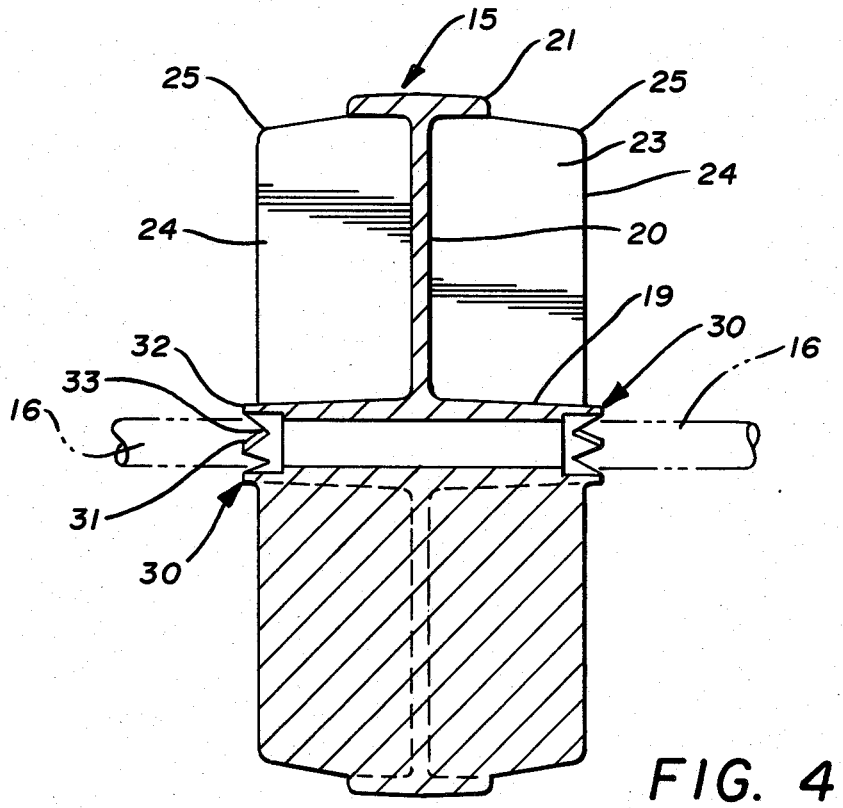
FIG. 4 is a cross-sectional view of one of the turbulence suppression devices taken substantially along line 4—4 of FIG. 3.
Figure 3:
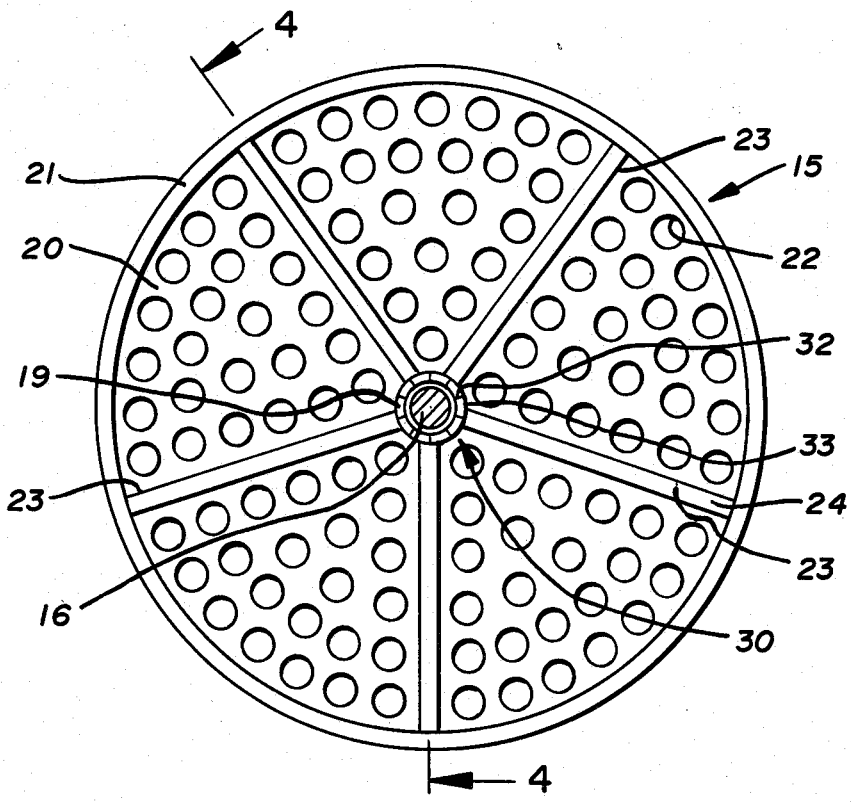
FIG. 3 is an end elevational view taken substantially along the line 3—3 of FIG. 2 showing details of the side of one of the turbulence suppression devices.

Turning now to FIGS. 3 and 4, where an individual wave suppression device 15 is shown in more detail, it will be seen that each consists of a supporting portion, which may include a hollow hub 19, having a central bore through which the cable 16 may pass freely. Along the length of the hub and preferably substantially medially, there is a radially extending web, or spider 20 (FIG. 3), which supports an annular ring-shaped cylindrical baffle member 21 in concentric relationship to the restraining cable 16 and the hub 19.

FIG. 2 schematically depicts a swimmer by the arrow labeled A proceeding in a swimming lane adjacent to one of the lane markers depicted in FIGS. 1 and 2. As schematically indicated in FIG. 2 a swimmer creates a wake to either side of the swimmer's body at an angle of approximately 135° to the direction of progress through the water. Thus, although in miniaturized form the wake of a swimmer bears a resemblance to the wake created by a boat or other vessel moving in water. The extent of the wake created by a swimmer is directly related to the speed of the swimmer through the water such that wake and related turbulence caused by a swimmer tends to be increasingly significant in competitive swimming activities.

As a result of a swimmer's travel relative to the lane markers 14 and individual wave suppression devices 15, the wake caused by a swimmer generally approaches at an angle of approximately 45° to the web member of the devices 15; however, it is to be appreciated that this is a simple approximation of the highly complex physical interrelation between numerous proximate and irregular wave forms. In addition to the damping and break up of a wave front that is effected by the cylindrical baffle member 21, the web member 20 is provided with a multiplicity of openings 22 through which waves and related turbulence are directed. Due to the angular incidence of the wave pattern it will be appreciated that a portion of the wave front may come directly into contact with the web 20 and pass through the openings 22 which serve to impede, dampen, aerate and otherwise break up the wave front. It is also to be noted that the baffle member 21 in extending axially in either direction from the web 20 tends to direct proximate water toward the web 20 and through the openings 22.

As shown, the openings 22 in web 20 may conveniently have a plurality of spaced holes substantially uniformly disposed over the entire surface of web 20. It has been emperically determined that improved wave damping may be realized by having approximately one-third of the surface area of web 20 being occupied by the openings 22. This relationship is believed to be optimized by employing openings comparable in size to openings that have been employed in the most effective prior art devices with the openings 22 being in closer proximity to adjacent openings, whereby the open portion of the web constitutes approximately twice the open area of the web of prior art devices. It is believed, however, that openings of a geometric configuration other than circular could be successfully employed to achieve comparable results observing the parameters set forth hereinabove.

In order to assist in breaking up and directing wave fronts toward the webs 20, the wave suppression devices 15 are provided with a series of axially extending baffle surfaces which may preferably be a series of equiangularly arranged vanes 23. The vanes 23 preferably extend radially outwardly from the hub 19 to the cylindrical baffle member 21. As shown in the preferred form in FIGS. 3 and 4, the vanes 23 extend substantially the axial length of the hub 19 and thus with a medially positioned web 20 an equal distance to either side of the web 20. As shown, there are five vanes 23 in each of the devices 15 spaced therefore at approximately 72° arcuate increments. While more or less of the vanes 23 could be employed successfully, this spacing has been found particularly appropriate for laterally directing waves toward the baffle members 21 to engage the hubs 19 while serving to strengthen and rigidify the entire device 15 to the interconnection between hub 19 and baffle 21. Each of the vanes 23 has axial margins 24 which are preferably directed substantially radially outwardly from the hub 19 to a position slightly radially below the baffle 21. At this point the vanes 23 have a curved corner 25 which merges into the underside of the baffle 21. The curved corner 25 resists breakage and eliminates what would otherwise be a relatively sharp point that could injure a swimmer coming into contact with the lane marker 14.

In the preferred form of wave suppression device 15, the vanes 23 are preferably of somewhat greater width than vanes of prior devices to facilitate redirecting the wave fronts to travel longitudinally of the lane markers 14 and to incidentally at the same time reduce the overall number of wave suppression devices 15 that are required for a given length of cable 16.

In prior devices the vanes 23 were significant in effecting rotation of lane marker elements to dissipate energy by the rotation of the elements. In such devices it could be observed that the various elements tended to rotate through an angle upon incidence of a wave front and thereafter effect an essentially reverse angular rotation through substantially the same angle after passage of the wave front. While certain prior art devices endeavored to provide some extent of resistance to rotation, the instant invention contemplates that the individual devices 15 be essentially nonrotatable relative to adjacent devices. The devices 15 are substantially nonrotatably mounted relative to adjacent devices 15 and relative to the cable 16 by virtue of interlocking elements, generally indicated by the numeral 30, positioned at each axial extremity of the hubs 19. More particularly, each interlocking element 30 consists of a sawtooth configuration having a plurality of spaced teeth 31 so configured as to matingly engage corresponding teeth of adjacent devices 15. The teeth 31 are preferably designed in such a fashion that axially extending points 32 of the teeth 31 are circumferentially positioned in alignment with each of the individual vanes 23 with there being intermediate recesses 33 constituting the axially inner extent of the teeth 31. The pitch line of the teeth 31 may be substantially axially aligned with the marginal edges 24 of the vanes 23 such that when adjacent devices 15 are placed in interlocking proximity with each other the adjacent marginal edges are just slightly axially displaced from one another.

Figure 5:
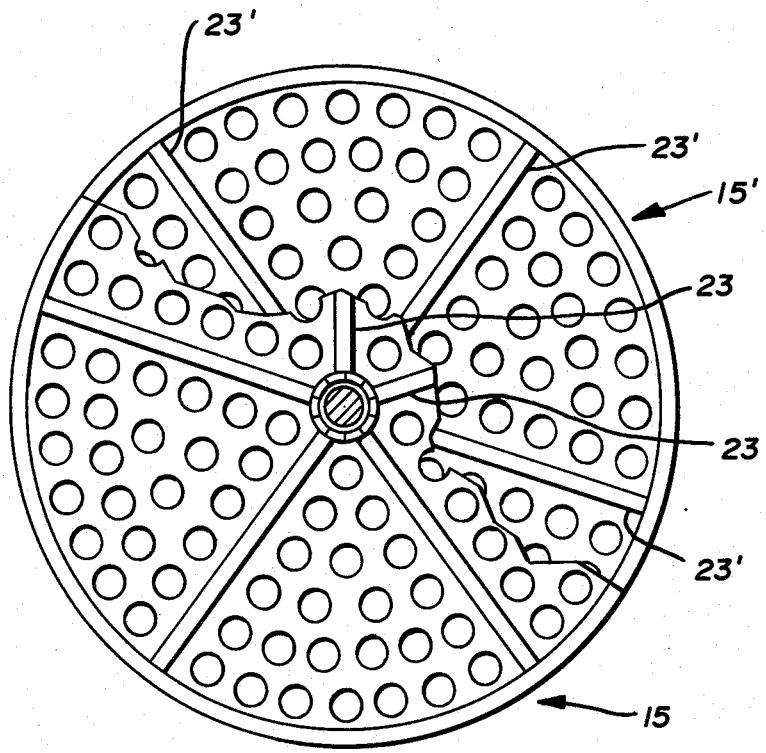
FIG. 5 is an end elevational view similar to FIG. 3 taken substantially along the line 5—5 of FIG. 2 with a portion of the proximate turbulence suppression device broken away to show the relationship of the radial vanes of the next adjacent, turbulence suppression device.

With the interlocking elements 30 precluding rotation between adjacent elements, the vanes 23 of the instant devices 15 serve primarily for purposes of redirecting incident wave fronts laterally of lane markers 14 with the primary wave suppression and damping effects taking place at the openings 22 of the web 20. In order to optimize the redirection of the wave fronts by the vanes 23, adjacent devices 15 preferably have the vanes of adjacent devices 15 offset in the preferred embodiment through an angle of approximately one-half the angle of adjacent vanes of the devices 15. As best seen in FIG. 5, a proximate device 15 is partially broken away to reveal the next adjacent device 15' on the opposite side thereof. As can be seen in FIG. 5 the vanes 23 of device 15 are angularly offset from the vanes 23' of the adjacent device 15'. This offset is depicted angularly by the angle $\theta$ which is 36° in an arrangement employing five vanes 23 spaced at 72° angular increments for each device 15. It is to be noted that with a single recess 33 between each of the points 32 of the interlocking elements 30 that the coaction of the interlocking elements 30 automatically positively effects the angular vane spacing depicted in FIG. 5.

While it is contemplated that devices 15 be substantially nonrotatably mounted relative to adjacent devices 15 so that the entire lane marker 14 has its devices 15 substantially nonrotatably mounted on a length of cable 16, an extent of localized movement may be provided by the design of the interlocking elements 30. In particular, the teeth 31 in being molded of polyethylene or comparable plastic may be compounded of sufficiently flexible material coupled with the tooth design to permit an extent of torsional compression and movement of interengaging teeth, e.g., a few degrees of relative rotation, when a localized wave action tends to impart extreme rotational forces on one of the devices 15 relative to an adjacent device. This torsional compression with an attendant return to the normal position once the wave form has passed produces a further source of energy absorption. This same extent of flexibility is instrumental in precluding damage to the teeth 31 in instances where the devices 15 may be accidentally or intentionally twisted through small angles as when engaged by a swimmer or when being removed from a body of water as for storage purposes. It will thus be seen that the devices 15 are preferably snugly positioned longitudinally of a cable 16 to essentially maintain a fixed but nonrigid rotational relationship of each adjacent device 15.

Referring particularly to FIG. 6 of the drawings there is shown the details of the floats 17 and the adjacent modified wave damping devices 18 previously identified. As may be seen in FIG. 6 the devices 18 are in most respects essentially identical to the wave suppression devices 15. In particular, the devices 18 have a hollow hub 119 having a central bore through which the cable 16 passes freely in a manner identical to the hollow hub 19. A radially extending web or spider (not shown) but identical to the spider 20 having openings (not shown) comparable to openings 22, supports an annular ring-shaped cylindrical baffle member 121 which may be identical to baffle 21. The devices 18 are also provided with a series of axially extending baffle surfaces which may be a series of equiangularly arranged vanes 12 comparable to the vanes 23 of devices 15. The devices 18 also have interconnecting elements, generally indicated by the numeral 130, which are identical to the interlocking elements 30 of the device 15 in having identically configured teeth 131 which are constructed for interrelationship with an adjacent device 18 having similar teeth 131.

The devices 18 differ from devices 15 only in that the vanes 123 in one axial direction from the central web member has a cutout 135 which is adapted to receive at least one-half of a float 17. Therefore, as further seen in FIG. 6, the float is preferably generally a toroidal member having a generally elliptical cross-section 136 with a hollow center through which the hubs 119 may extend to bring interconnecting elements 131 into mating engagement with the elements 131 of adajcent devices. As depicted in FIG. 2, the spacing and continuity of the lane marker 14 is substantially maintained throughout its entire length with the fixed but nonrigid rotational relationship being maintained between devices 18 adjacent the floats 17. Further, with the cutouts 135 of adjacent devices 18 accommodating the float 17 the marginal edges 124 of the vanes 123 having cutouts 135 are maintained in substantially the same axial spacing as in the devices 15.

Thus it should be evident that the wave suppression device disclosed herein carries out the various objects of the invention set forth hereinabove and otherwise constitutes an advantageous contribution to the art. As may be apparent to persons skilled in the art, modifications can be made to the preferred embodiment disclosed herein without departing from the spirit of the invention, the scope of the invention being limited solely by the scope of the attached claims.

I claim:

1. A device for use in a body of water as one of a plurality of such devices assembled in axial alignment with one another along a restraining element to suppress incident wave turbulence, said devices comprising, hub means adapted to receive the restraining element, a plurality of planar vane means for directing incident water extending generally radially and axially of said hub means, annular baffle means disposed proximate the radial extremity of said vane means, web means for suppressing wave turbulence extending radially of said hub means and oriented substantially perpendicular to said vane means, and interlocking means on said hub means matingly engaging opposed interlocking means of adjacent devices for precluding relative rotation between adjacent of such devices assembled along the restraining element, said interlocking means being a sawtooth configuration positioned on the axial extremity of said hub means.

2. A device according to claim 1 wherein said sawtoothed configurations are positioned on each axial extremity of said hub means.

3. A device according to claim 2 wherein said vane means are of substantially the same axial length as said hub means.

4. A device according to claim 3 wherein said vane means have axial margins which are substantially radially directed.

5. A device according to claim 4 wherein said sawtoothed configurations are positioned axially a sufficient distance such that said axial margins of adjacent devices with said sawtoothed configurations in mating engagement extend to a position proximate to but spaced from each other.

6. A device according to claim 5 wherein said sawtoothed configuration has teeth with the pitch line of said teeth being substantially axially aligned with said marginal edge of said vane means.

7. A device according to claim 6 wherein said teeth consist of points and intermediate recesses.

8. A device according to claim 7 wherein said points of said teeth are circumferentially positioned in alignment with one of said vane means.

9. A device according to claim 8 wherein the engagement of a point of a tooth of one device with a recess of an adjacent device places opposed vane means of adjacent devices offset through an angle of approximately one-half the angle between adjacent of said vane means of a device.

10. A device according to claim 9 wherein there are five said vane means in each of said devices.

11. A device according to claim 10 wherein each of said vane means extend substantially the full axial length of said hub means.

12. A device according to claim 11, wherein said baffle means are disposed about said web means.

13. A device according to claim 12, wherein said baffle means is disposed substantially axially medially of said vane means.

14. A device according to claim 1 wherein said web means has a plurality of spaced openings disposed substantially uniformly thereover.

15. A device according to claim 14 wherein said openings are circular and occupy approximately one-third of the surface area of said web means.

16. A device for use in a body of water as one of a plurality of such devices assembled in axial alignment with one another along a restraining element to suppress incident wave turbulence, said devices comprising, hub means adapted to receive the restraining element, a plurality of planar vane means for directing incident water extending generally radially and axially of said hub means, annular baffle means disposed proximate the radial extremity of said vane means, web means for suppressing wave turbulence extending radially of said hub means and oriented substantially perpendicular to said vane means, and means on said hub means precluding relative rotation between adjacent of such devices assembled along the restraining element, said means on said hub means for precluding relative rotation includes teeth for interlocking with teeth of adjacent of such devices.

17. A device according to claim 16, wherein said teeth permit slight relative rotation between adjacent of such devices.

18. A device according to claim 17 wherein said teeth are of a flexible plastic material compounded to permit the torsional compression.

* * * * *